US011435082B2

(12) United States Patent
Kim et al.

(10) Patent No.: US 11,435,082 B2
(45) Date of Patent: Sep. 6, 2022

(54) FUEL SUPPLY DEVICE

(71) Applicant: HANWHA AEROSPACE CO., LTD., Changwon-si (KR)

(72) Inventors: Ju Pyoung Kim, Changwon-si (KR); Sin Hyen Kim, Changwon-si (KR); Seung Chai Jung, Changwon-si (KR); Su Hyeong Cho, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 0 days.

(21) Appl. No.: 17/333,971

(22) Filed: May 28, 2021

(65) Prior Publication Data

US 2022/0196240 A1 Jun. 23, 2022

(30) Foreign Application Priority Data

Dec. 18, 2020 (KR) ..... 10-2020-0178929

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01); *F23R 3/283* (2013.01)

(58) Field of Classification Search
CPC .... F23R 3/14; F23R 3/28; F23R 3/283; F23R 3/286; F23D 14/48
See application file for complete search history.

(56) References Cited

U.S. PATENT DOCUMENTS 6,247,317 B1 * 6/2001 Kostka ..... F23C 7/02 60/741
6,289,676 B1 9/2001 Prociw et al.
8,015,815 B2 * 9/2011 Pelletier ..... F23R 3/14 60/742
8,196,845 B2 * 6/2012 Thomson ..... F23D 11/107 239/397.5

(Continued)

FOREIGN PATENT DOCUMENTS

JP 5887291 B2 3/2016
JP 2020-85290 A 6/2020

(Continued)

*Primary Examiner* — William H Rodriguez
(74) *Attorney, Agent, or Firm* — Sughrue Mion, PLLC

(57) ABSTRACT

A fuel supply device includes: an outer tubular member; an inner tubular member inside the outer tubular member; and a flow distribution portion on an inner surface of the outer tubular member or an outer surface of the inner tubular member, wherein the flow distribution portion includes first and second distribution wall portions arranged apart from one another in an axial direction of the inner tubular member, the first distribution wall portion includes first individual wall portions spaced apart from one another along a first circumference of the inner tubular member, the second distribution wall portion includes second individual wall portions spaced apart from one another along a second circumference of the inner tubular member, at least some of the first individual wall portions are arranged to face spaces between at least some of the second individual wall portions, respectively, in the axial direction of the inner tubular member.

15 Claims, 4 Drawing Sheets

(56) References Cited

U.S. PATENT DOCUMENTS

| | | | | |
|---|---|---|---|---|
| 8,240,151 | B2 * | 8/2012 | Pelletier | F23R 3/14 60/742 |
| 9,074,764 | B2 * | 7/2015 | Hull | F23R 3/343 |
| 11,053,854 | B1 * | 7/2021 | McIntyre, II | F02C 7/222 |
| 2009/0044538 | A1 * | 2/2009 | Pelletier | F23R 3/14 60/740 |
| 2009/0202954 | A1 * | 8/2009 | Tsung | F23D 14/48 431/153 |
| 2009/0217669 | A1 * | 9/2009 | Young | F23R 3/28 60/737 |
| 2010/0300105 | A1 * | 12/2010 | Pelletier | F23R 3/286 239/398 |
| 2014/0090394 | A1 * | 4/2014 | Low | F23R 3/28 60/776 |
| 2016/0097538 | A1 * | 4/2016 | Wang | F23D 11/383 60/737 |
| 2017/0328558 | A1 * | 11/2017 | Wang | F23D 11/103 |

FOREIGN PATENT DOCUMENTS

| | | | |
|---|---|---|---|
| KR | 10-1781722 | B1 | 9/2017 |
| KR | 10-2019-0078290 | A | 7/2019 |
| WO | 2016/042787 | A1 | 3/2016 |

* cited by examiner

FUEL SUPPLY DEVICE

CROSS-REFERENCE TO RELATED APPLICATION

This application is based on and claims priority from Korean Patent Application No. 10-2020-0178929, filed on Dec. 18, 2020, in the Korean Intellectual Property Office, the disclosure of which is incorporated by reference herein in its entirety.

BACKGROUND

1. Field

One or more embodiments relate to a fuel supply device for supplying fuel.

2. Description of the Related Art

In general, an internal combustion engines such as a gas turbine engine includes a combustor, and, in the combustor, a mixture of air and fuel is combusted.

In the process of supplying fuel and mixing the fuel with the air, when liquid fuel is atomized due to a difference in the relative velocity between the liquid fuel and the air, how uniformly the supplied liquid fuel flows becomes an important factor.

Usually, a swirler is used so that the liquid fuel rotates in order to equalize the flow of the liquid fuel. However, even when a swirler is used, the liquid fuel often flows skewed to one side, and, in that case, it is difficult to achieve uniform flow.

SUMMARY

One or more embodiments provide a fuel supply device enabling a uniform flow of liquid fuel.

Various aspects of the disclosure will be set forth in part in the description which follows and, in part, will be apparent from the description, or may be learned by practice of the presented embodiments.

According to one or more embodiments, a fuel supply device may include: an outer tubular member; an inner tubular member arranged inside the outer tubular member to form a liquid fuel path with an inner surface of the outer tubular member; and a flow distribution portion arranged between the inner surface of the outer tubular member and an outer surface of the inner tubular member to distribute the flow of liquid fuel flowing in the liquid fuel path, wherein the flow distribution portion includes at least two distribution wall portions arranged apart from each other in a flow direction of the liquid fuel, wherein each of the distribution wall portions includes a plurality of individual wall portions arranged apart from one another along a circumference of the inner tubular member, and wherein the individual wall portions constituting a first distribution wall portion among the distribution wall portions are arranged to respectively correspond to spaces between the individual wall portions of a second distribution wall portion among the distribution wall portions adjacent to the first distribution wall portion among the distribution wall portions.

The fuel supply device may further include a fuel supply pipe connected to the liquid fuel path and disposed on the outer tubular member.

The fuel supply device may further include a shroud installed outside the outer tubular member.

The fuel supply device may further include a swirler arranged between an inner surface of the outer tubular member and an outer surface of the inner tubular member and at a downstream side of the flow distribution portion based on a flow direction of the liquid fuel.

A guide vane for guiding a flow of air may be arranged inside the inner tubular member.

At least one of the distribution wall portions may further include a plurality base portions formed higher than the outer surface of the inner tubular member.

The number of the distribution wall portions may be two or more.

BRIEF DESCRIPTION OF DRAWINGS

The above and other aspects, features, and advantages of certain embodiments of the disclosure will be more apparent from the following description taken in conjunction with the accompanying drawings, in which.

DETAILED DESCRIPTION

Figure 1:
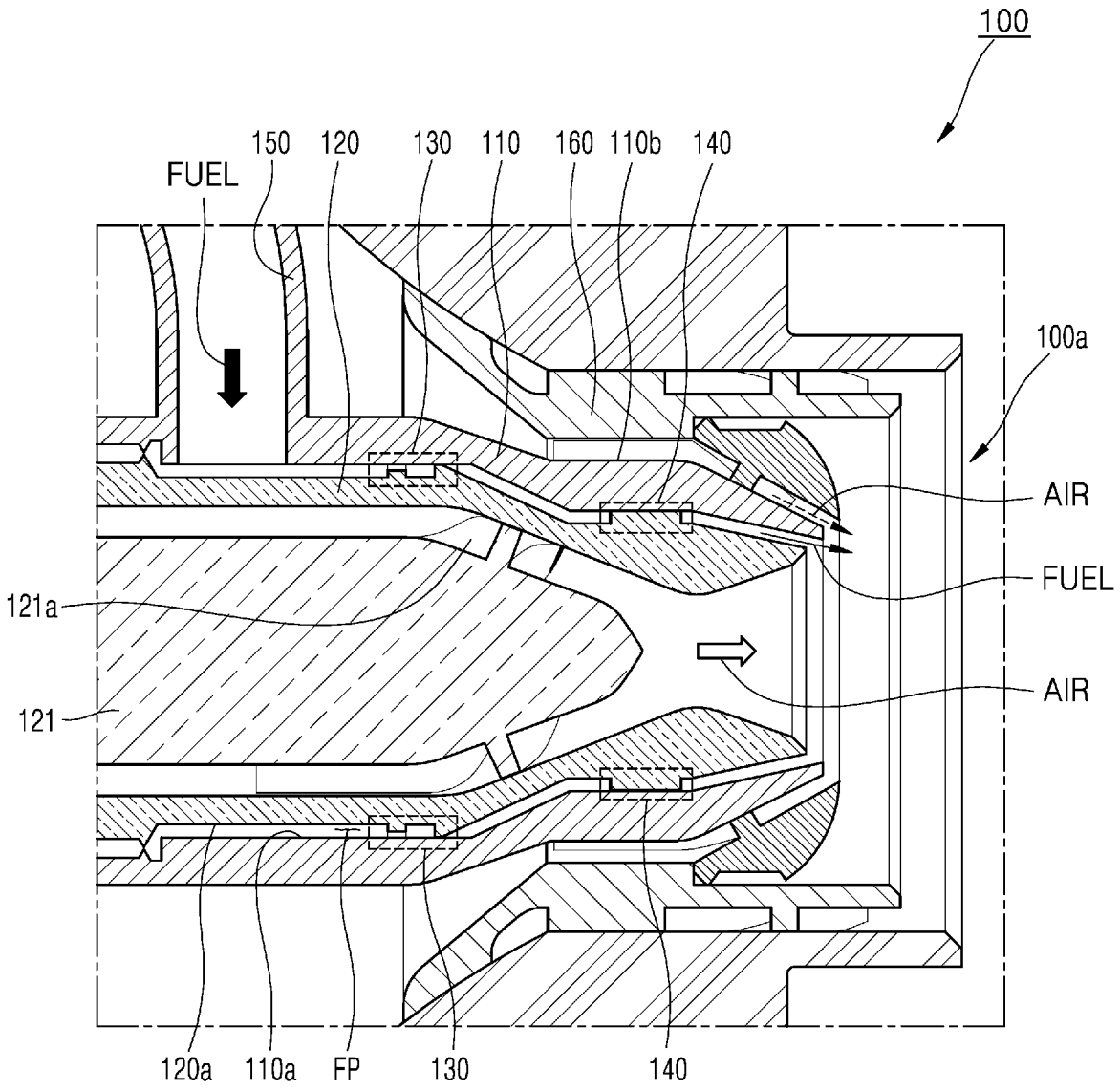
FIG. 1 is a cross-sectional view of a fuel supply device, according to an embodiment.

Reference will now be made in detail to embodiments, examples of which are illustrated in the accompanying drawings, wherein like reference numerals refer to like elements throughout. The embodiments described herein are all example embodiments, and thus, the disclosure is not limited thereto and may be realized in various other forms.

As used herein, the term "and/or" includes any and all combinations of one or more of the associated listed items. Expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "below," "under," "beneath," "connected to" or "coupled to" another element or layer, it can be directly over, above, on, below, under, beneath, connected or coupled to the other element or layer or intervening elements or layers may be present. In contrast, when an element is referred to as being "directly over," "directly above," "directly on," "directly below," "directly under," "directly beneath," "directly connected to" or "directly coupled to" another element or layer, there are no intervening elements or layers present.

Spatially relative terms, such as "over," "above," "on," "upper," "below," "under," "beneath," "lower," and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terms "comprises" and/or "comprising," when used in this specification, specify the presence of stated components, steps, operations and/or elements, but do not preclude the presence or addition of one or more other components, steps, operations and/or elements. It will be understood that, although the terms first, second, etc. may be used herein to describe various elements, these elements should not be limited by these terms. These terms are used only to distinguish one component from another.

Figure 2:
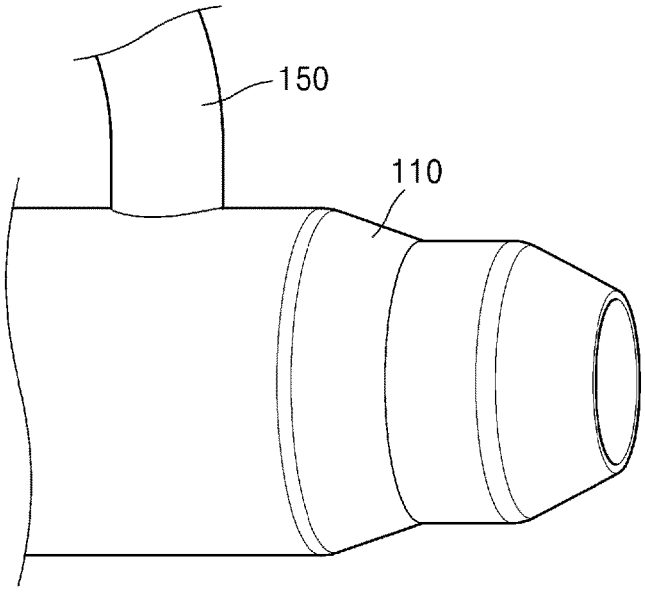
FIG. 2 is a view illustrating the appearance of an outer tubular member and a fuel supply pipe of a fuel supply device, according to an embodiment.
Figure 3:
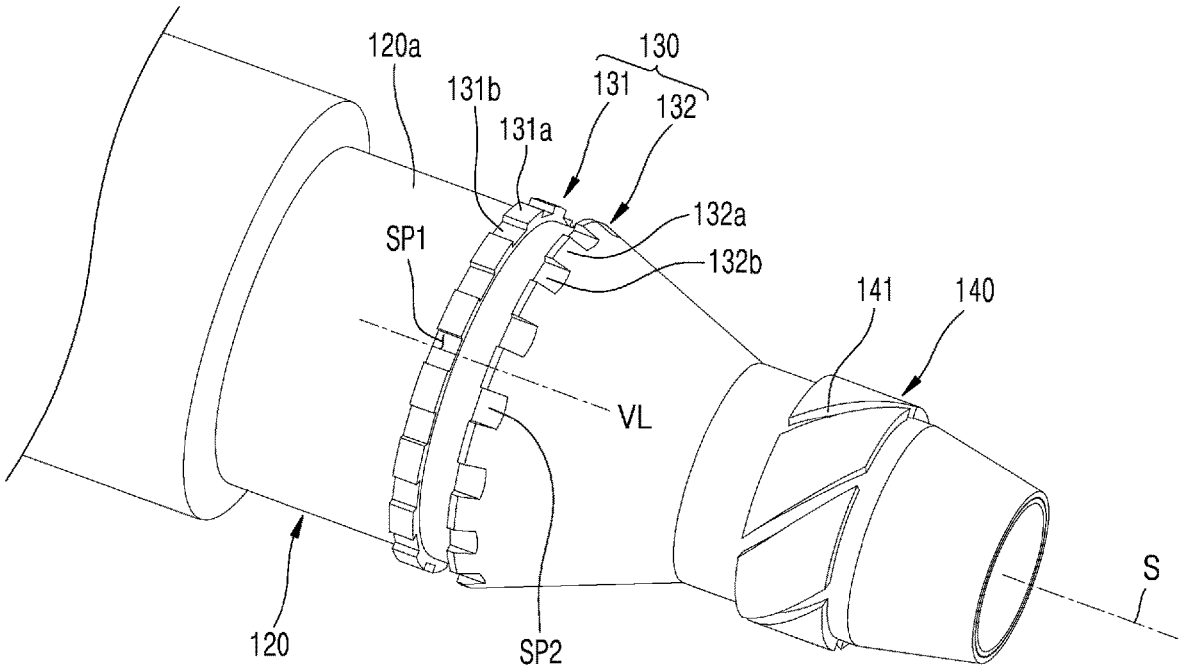
FIG. 3 is a view illustrating the appearance of an inner tubular member of a fuel supply device, according to an embodiment.
Figure 4:
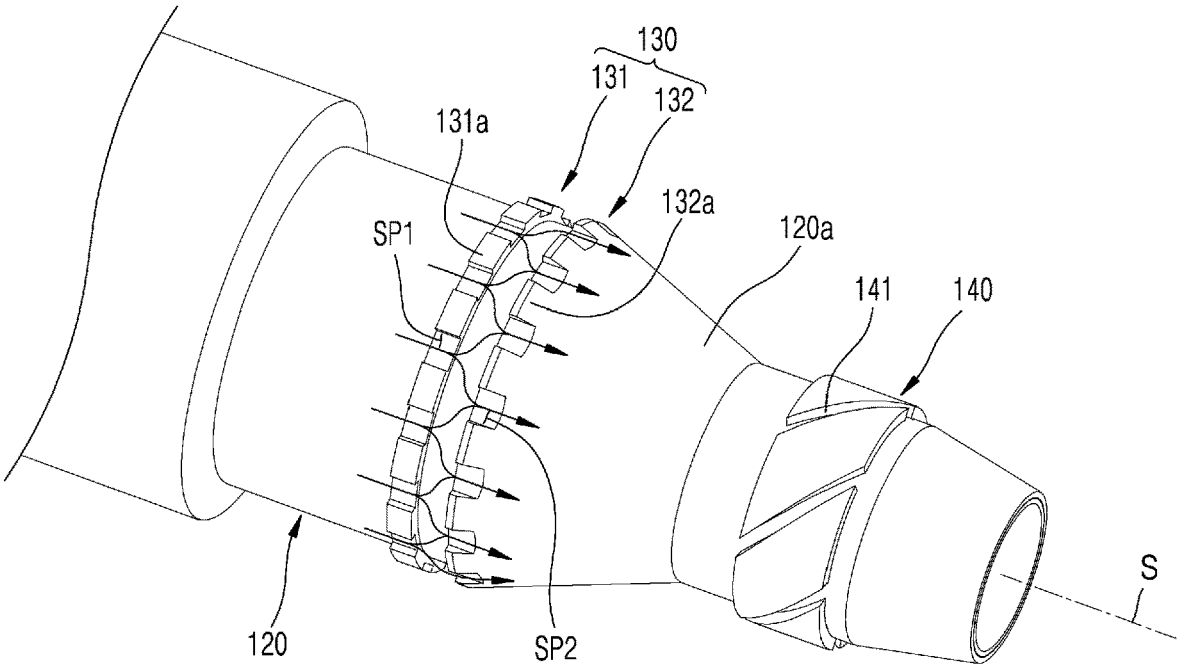
FIG. 4 is a view illustrating a state in which liquid fuel is distributed and flowed by a flow distribution portion, according to an embodiment for explanation.

FIG. 1 is a schematic cross-sectional view of a fuel supply device, according to an embodiment, FIG. 2 is a schematic view illustrating the appearance of an outer tubular member and a fuel supply pipe of a fuel supply device, according to an embodiment, and FIG. 3 is a schematic view illustrating the appearance of an inner tubular member of a fuel supply device, according to an embodiment. FIG. 4 is a schematic view illustrating a state in which liquid fuel is distributed and flowed by a flow distribution portion, according to an embodiment.

As illustrated in FIGS. 1 and 2, a fuel supply device 100 of the present embodiment includes an outer tubular member 110, an inner tubular member 120, a flow distribution portion 130, a swirler 140, a fuel supply pipe 150 and a shroud 160.

The fuel supply device 100 of the present embodiment is applied to a gas turbine engine, but the disclosure is not limited thereto. That is, the fuel supply device 100 according to the embodiment may be applied not only to a gas turbine engine but also to various devices. For example, the fuel supply device 100 according to the embodiment may be applied to another type of internal combustion engine using liquid fuel, various outer combustion engines, rocket engines, and the like.

The outer tubular member 110 has a shape of a tube as a whole according to an embodiment, and the inner tubular member 120 is arranged therein. However, the disclosure is not limited thereto, and the outer tubular member 110 may have various different shapes, according to embodiments.

An outer diameter of a portion of the outer tubular member 110 where the fuel supply pipe 150 is disposed is greater than an outer diameter of a portion of the outer tubular member 110 that is close to an outlet 100*a* of the fuel supply device 100, but the disclosure is not limited thereto.

The inner tubular member 120 has a shape of a tube as a whole according to an embodiment, and is arranged inside the outer tubular member 110 to form a liquid fuel path FP together with an inner surface 110*a* of the outer tubular member 110. That is, an outer surface 120*a* of the inner tubular member 120 and the inner surface 110*a* of the outer tubular member 110 form the liquid fuel path FP. The shape of the inner tubular member 120 may not be limited to the shape of a tube, and may take various different shapes, according to embodiments.

Air flows inside the inner tubular member 120, and a core 121 and a guide vane 121*a* for guiding the flow of air around the core 121 may be arranged inside the inner tubular member 120.

Meanwhile, the flow distribution portion 130 is arranged between the inner surface 110*a* of the outer tubular member 110 and the outer surface 120*a* of the inner tubular member 120 to distribute the flow of liquid fuel flowing in the liquid fuel path FP.

The flow distribution portion 130 of the present embodiment is formed on the outer surface 120*a* of the inner tubular member 120 for convenience of manufacturing and assembly.

The flow distribution portion 130 of the present embodiment is formed on the outer surface 120*a* of the inner tubular member 120, but the disclosure is not limited thereto. That is, the flow distribution portion 130 may be formed and/or assembled on the inner surface 110*a* of the outer tubular member 110.

As shown in FIG. 3, the flow distribution portion 130 includes a first distribution wall portion 131 and a second distribution wall portion 132.

The first distribution wall portion 131 and the second distribution wall portion 132 are arranged apart from each other in a flow direction of liquid fuel. The first distribution wall portion 131 is adjacent to the second distribution wall portion 132, and is arranged further upstream than the second distribution wall portion 132.

The first distribution wall portion 131 includes a plurality of individual wall portions 131*a* and a plurality of base portions 131*b*.

The plurality of individual wall portions 131*a* are arranged apart from one another at certain intervals along a first circumference of the inner tubular member 120. Thus, the individual wall portions 131*a* may be formed between the base portions 131*b*, and the base portions 131*b* may be formed between the individual wall portions 131*a*, along the first circumference of the inner tubular member 120. In addition, the base portions 131*b* are formed slightly higher than the outer surface 120*a* of the inner tubular member 120.

The base portions 131*b* of the first distribution wall portion 131 according to the embodiment are formed to be slightly higher than the outer surface 120*a* of the inner tubular member 120, and such a structure is to achieve proper harmony with the flow of liquid fuel passing through the downstream swirler 140 by adjusting the flow rate, distribution flow, etc. of liquid fuel passing through the first distribution wall portion 131 using the height of the base portions 131*b* during design. Accordingly, if it is determined to be necessary for design, the height of the base portions 131*b* of the first distribution wall portion 131 may be adjusted differently from the case of the present embodiment. For example, the base portions 131*b* of the first distribution wall portion 131 may be formed to coplanar with the outer surface 120*a* of the inner tubular member 120. In this case, the base portions 131*b* themselves may be a part of the outer surface 120*a* of the inner tubular member 120.

The second distribution wall portion 132 also includes a plurality of individual wall portions 132*a* and a plurality of base portions 132*b*.

The plurality of individual wall portions 132*a* are arranged apart from one another at certain intervals along a second circumference of the inner tubular member 120. Thus, the individual wall portions 132*a* may be formed between the base portions 132*b*, and the base portions 132*b* may be formed between the individual wall portions 132*a*, along the second circumference of the inner tubular member 120. In addition, the base portion 132*b* is formed slightly higher than the outer surface 120*a* of the inner tubular member 120.

The base portions 132*b* of the second distribution wall portion 132 according to the present embodiment are formed to be slightly higher than the outer surface 120*a* of the inner tubular member 120, and such a structure is to achieve proper harmony with the flow of liquid fuel passing through the downstream swirler 140 by adjusting the flow rate, distribution flow, etc. of liquid fuel passing through the second distribution wall portion 132 using the height of the base portions 132*b* during design. Accordingly, if it is determined to be necessary for design, the height of the base portions 132*b* of the second distribution wall portion 132 may be adjusted differently from the case of the present embodiment. For example, the base portions 132*b* of the second distribution wall portion 132 may be formed to be coplanar with the outer surface 120*a* of the inner tubular member 120. In this case, the base portions 132*b* themselves may also be a part of the outer surface 120*a* of the inner tubular member 120.

According to embodiments, the base portions 132*b* may be formed to be slightly higher than the outer surface 120*a* of the inner tubular member 120, while the base portions 132*b* are formed to be coplanar with the outer surface 120*a* of the inner tubular member 120, and vice versa.

Because upper portions of the individual wall portions 131*a* and 132*a* are formed to contact the inner surface 110*a* of the outer tubular member 110 during assembly, the flow of liquid fuel is restricted by the individual wall portions 131*a* and 132*a*.

The individual wall portions 132*a* are arranged to correspond to or face spaces SP1 between the individual wall portions 131*a*. That is, as shown in FIG. 3, when viewed in an axial direction S of the inner tubular member 120, the individual wall portions 131*a* and 132*a* are arranged such that a virtual line VL parallel to the axial direction S passes through an individual wall portion 132*a* and the space SP1 between the individual wall portions 131*a*.

Due to the arrangement of the individual wall portions 131*a* and 132*a*, as shown in FIG. 4, the flow of liquid fuel (marked by an arrow) formed by an individual wall portion 131*a* is split and distributed by the individual wall portion 132*a* adjacent to the individual wall portion 131*a*. That is, the flow of the liquid fuel (marked by an arrow) formed by the individual wall portions 131*a* splits into a space SP2 between the individual wall portions 132*a* and flows. The arrow indicating the flow of the liquid fuel in FIG. 4 is simplified and drawn as an example, and may actually represent a more complex flow.

The swirler 140 is a portion that causes liquid fuel to turn, and the liquid fuel turns while passing through a turning path 141 of the swirler 140.

The swirler 140 is arranged between the inner surface 110*a* of the outer tubular member 110 and the outer surface 120*a* of the inner tubular member 120, and is on a downstream side of the flow distribution portion 130 based on a flow direction of liquid fuel.

The swirler 140 of the present embodiment is disposed on the outer surface 120*a* of the inner tubular member 120 for convenience of manufacturing and assembly.

The swirler 140 of the present embodiment is disposed on the outer surface 120*a* of the inner tubular member 120, but the disclosure is not limited thereto. That is, the swirler 140 according to the disclosure may be disposed and assembled on the inner surface 110*a* of the outer tubular member 110.

One end of the fuel supply pipe 150 is disposed on the outer tubular member 110, and the fuel supply pipe 150 is connected to the liquid fuel path FP. Liquid fuel supplied to the fuel supply pipe 150 is supplied to the liquid fuel path FP.

The shroud 160 is disposed outside the outer tubular member 110, and air flows between the shroud 160 and an outer surface 110*b* of the outer tubular member 110 when the fuel supply device 100 is operated.

Hereinafter, a state in which the fuel supply device 100 according to the present embodiment is operated will be described with reference to FIGS. 1 to 5.

When liquid fuel having a certain pressure is supplied to the fuel supply pipe 150, the liquid fuel is supplied to the liquid fuel path FP connected to the fuel supply pipe 150.

The liquid fuel supplied to the liquid fuel path FP moves to the flow distribution portion 130 to distribute the flow of the liquid fuel, which will be described in detail later below.

The liquid fuel supplied to the liquid fuel path FP moves toward the first distribution wall portion 131, and because of the existence of the individual wall portions 131*a* of the first distribution wall portion 131, the liquid fuel flows into the space SP1 between the individual wall portions 131*a*.

The liquid fuel flowing into the space SP1 between the individual wall portions 131*a* collides with the individual wall portions 132*a* of the second distribution wall portion 132 and splits into the space SP2 between the individual wall portions 132*a* and flows. That is, the flow of the liquid fuel is split and distributed while passing through the first distribution wall portion 131 and the second distribution wall portion 132 in sequence, so that the flow of the liquid fuel is uniform in the liquid fuel path FP.

Figure 5:
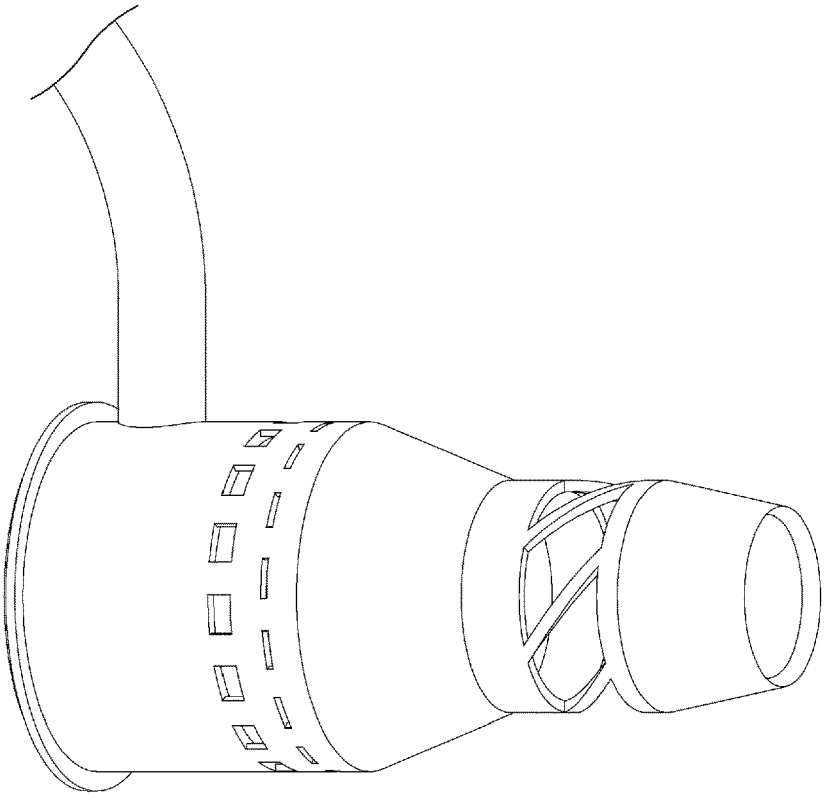
FIG. 5 is a view illustrating a flow state of liquid fuel flowing inside a fuel supply device, according to an embodiment in three dimensions.

The liquid fuel in which the flow is evenly distributed through the second distribution wall portion 132 moves to the swirler 140 and turns while passing through the turning path 141 of the swirler 140. In FIG. 5, a flow state of liquid fuel from the fuel supply pipe 150 to the outlet 100*a* of the fuel supply device 100 is shown in three dimensions.

The liquid fuel passing through the swirler 140 is discharged to the outlet 100*a* of the fuel supply device 100, and collides with an air flow flowing inside the inner tubular member 120 and outside the outer tubular member 110, and then, the liquid fuel is atomized due to a difference in the relative velocity between the air flow and the liquid fuel.

As described above, the fuel supply device 100 according to the present embodiment includes the first distribution wall portion 131 and the second distribution wall portion 132 for distributing the flow of liquid fuel flowing in the liquid fuel path FP, and the individual wall portions 132*a* of the second distribution wall portion 132 are arranged to correspond to or face spaces between the individual wall portions 131*a* of the first distribution wall portion 131, respectively. Accordingly, the liquid fuel supplied to the liquid fuel path FP is split and distributed while passing through the first distribution wall portions 131 and the second distribution wall portion 132 in sequence, and thus, the flow of the liquid fuel may be made uniform. Then, in the subsequent mixing process with air, the liquid fuel may be effectively atomized.

According to embodiments, the number of the individual wall portions 132*a* and the number of the base portions 132*b* may be the same as or different from the number of the individual wall portions 131*a* and the number of the base portions 131*b*, respectively, according to embodiments. Thus, the interval between two adjacent individual wall portions 132*a* along the second circumference of the inner tubular member 120 may be the same as or different from the interval between two adjacent individual wall portions 131*a* along the first circumference of the inner tubular member 120. Further, according to embodiments, the individual wall portions 131*a* may be arranged at the same or different intervals along the first circumference of the inner tubular member 120, and the individual wall portions 132*a* may also be arranged at the same or different intervals along the second circumference of the inner tubular member 120. Moreover, according to embodiments, the first circumferential length connecting the individual wall portions 131*a* may be the same as or different from the second circumferential length connecting the individual wall portions 132*a*. It is understood that, compared to the previous embodiment, these embodiments may be implemented to enable the liquid fuel supplied to the liquid fuel path FP to be differently split and distributed while passing through the first distribution wall portions 131 and the second distribution wall portion 132 in sequence.

The flow distribution portion 130 according to the present embodiment includes two distribution wall portions, that is, the first distribution wall portion 131 and the second distribution wall portion 132, but the disclosure is not limited thereto. That is, there is no particular limitation on the number of distribution wall portions included in a flow distribution portion according to the disclosure. For example, the number of distribution wall portions included in the flow distribution portion may be 3, 4, or 5. As an example, hereinafter, a modified embodiment in which a flow distribution portion has three distribution wall portions will be described with reference to FIG. 6.

Figure 6:
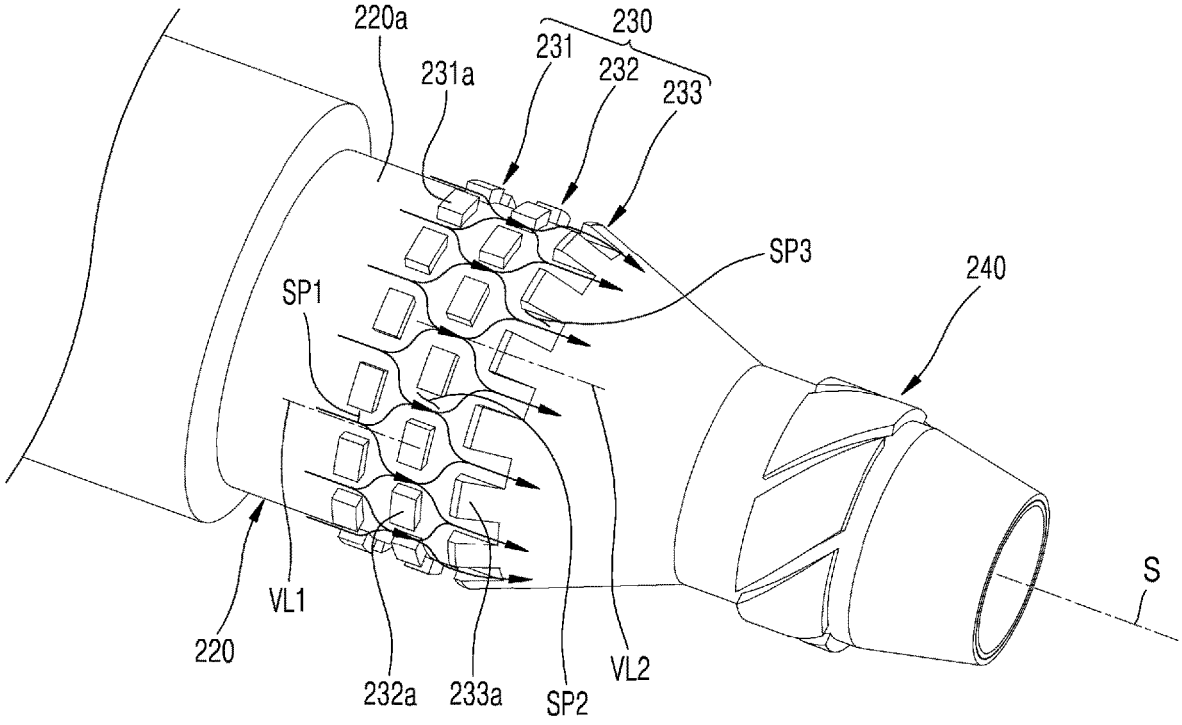
FIG. 6 is a view illustrating the appearance of an inner tubular member of a fuel supply device, according to an embodiment.

FIG. 6 is a view illustrating the appearance of an inner tubular member of a fuel supply device, according to an embodiment.

A flow distribution portion 230 according to the present embodiment includes a first distribution wall portion 231, a second distribution wall portion 232, and a third distribution wall portion 233.

The first distribution wall portion 231, the second distribution wall portion 232, and the third distribution wall portion 233 are arranged to be spaced apart from one another in the axial direction S of the inner tubular member 120. The second distribution wall portion 232 is adjacent to the first distribution wall portion 231, and the third distribution wall portion 233 is adjacent to the second distribution wall portion 232.

The first distribution wall portion 231 is arranged further upstream than the second distribution wall portion 232, and the second distribution wall portion 232 is arranged further upstream than the third distribution wall portion 233.

Each of the first distribution wall portion 231, the second distribution wall portion 232, and the third distribution wall portion 233 include a plurality of individual wall portions 231*a*, 232*a* and 233*a*, wherein the plurality of individual wall portions 231*a*, 232*a* and 233*a* are arranged apart from one another at certain intervals along the circumference of an inner tubular member 220. The first distribution wall portion 231, the second distribution wall portion 232, and the third distribution wall portion 233 according to the present embodiment do not include base portions unlike the first distribution wall portion 131 and the second distribution wall portion 132 described above, but the disclosure is not limited thereto, and may include the base portions.

Because the individual wall portions 231*a*, 232*a* and 233*a* are formed to contact an inner surface of an outer tubular member (not shown) during assembly, the flow of liquid fuel is restricted by the individual wall portions 231*a*, 232*a* and 233*a*.

The individual wall portions 232*a* are arranged to correspond to or face the spaces SP1 between the individual wall portions 231*a*, respectively. That is, when viewed in the axial direction S of the inner tubular member 220, the individual wall portions 231*a* and 232*a* are arranged such that a virtual line VL1 parallel to the axial direction S passes through the individual wall portion 232*a* and the space SP1 between the individual wall portions 231*a*.

In addition, the individual wall portions 233*a* are arranged to correspond to or face the space SP2 between the individual wall portions 232*a*. That is, when viewed in the axial direction S of the inner tubular member 220, the individual wall portions 232*a* and 233*a* are arranged such that a virtual line VL2 parallel to the axial direction S passes through the individual wall portion 233*a* and the space SP2 between the individual wall portions 232*a*.

Due to the arrangement of the individual wall portions 231*a*, 232*a* and 233*a*, the flow of liquid fuel (marked by an arrow) formed by the individual wall portion 231*a* is split and distributed by the individual wall portion 232*a* adjacent to the individual wall portion 231*a*. That is, the flow of the liquid fuel (marked by an arrow) formed by the individual wall portions 231*a* splits into the space SP2 between the individual wall portions 232*a* and flows. In addition, the flow of the liquid fuel (marked by an arrow) formed by the individual wall portion 232*a* is split and distributed by the individual wall portion 233*a* adjacent to the individual wall portion 232*a*. That is, the flow of the liquid fuel (marked by an arrow) formed by the individual wall portions 232*a* splits into a space SP3 between the individual wall portions 233*a* and flows. The arrow indicating the flow of the liquid fuel in FIG. 6 is simplified and drawn as an example, and may actually represent a more complex flow.

In other words, the flow of the liquid fuel is split and distributed while passing through the first distribution wall portion 231, the second distribution wall portion 232, and the third distribution wall portion 233 in sequence, so that the flow of the liquid fuel in the liquid fuel path FP becomes uniform, and then, in a process of mixing with air through the swirler 240, the liquid fuel may be effectively atomized.

According to a fuel supply device according to the embodiments, a uniform flow of liquid fuel may be possible, and thus, when air and liquid fuel are mixed, atomization performance of the liquid fuel may be improved.

A fuel supply device according to the present embodiment may be used in an industry that manufactures, tests, or operates a device for supplying liquid fuel.

It should be understood that the embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A fuel supply device comprising:

an outer tubular member;

an inner tubular member arranged inside the outer tubular member to form a liquid fuel path with an inner surface of the outer tubular member; and a flow distribution portion arranged between the inner surface of the outer tubular member and an outer surface of the inner tubular member to distribute a flow of liquid fuel flowing in the liquid fuel path, wherein the flow distribution portion comprises at least two distribution wall portions arranged apart from each other in a flow direction of the liquid fuel, wherein each of the distribution wall portions includes a plurality of individual wall portions arranged apart from one another along a circumference of the inner tubular member, and wherein the individual wall portions constituting a first distribution wall portion among the distribution wall portions are arranged to respectively correspond to spaces between the individual wall portions of a second distribution wall portion among the distribution wall portions adjacent to the first distribution wall portion among the distribution wall portions.

2. The fuel supply device of claim 1, further comprising a fuel supply pipe connected to the liquid fuel path and disposed on the outer tubular member.

3. The fuel supply device of claim 1, further comprising a shroud installed outside the outer tubular member.

4. The fuel supply device of claim 1, further comprising a swirler arranged between an inner surface of the outer tubular member and an outer surface of the inner tubular member, and at a downstream side of the flow distribution portion based on the flow direction of the liquid fuel.

5. The fuel supply device of claim 1, wherein a guide vane for guiding a flow of air is arranged inside the inner tubular member.

6. The fuel supply device of claim 1, wherein at least one of the distribution wall portions further comprises a plurality of base portions formed between individual wall portions to be higher than the outer surface of the inner tubular member.

7. The fuel supply device of claim 1, wherein a number of the distribution wall portions is two or more.

8. A fuel supply device comprising:

an outer tubular member;

an inner tubular member arranged inside the outer tubular member; and a flow distribution portion arranged on an inner surface of the outer tubular member or an outer surface of the inner tubular member, wherein the flow distribution portion comprises a first distribution wall portion and a second distribution wall portion arranged apart from one another in an axial direction of the inner tubular member, wherein the first distribution wall portion comprises a plurality of first individual wall portions spaced apart from one another along a first circumference of the inner tubular member, and the second distribution wall portion comprises a plurality of second individual wall portions spaced apart from one another along a second circumference of the inner tubular member, wherein at least some of the first individual wall portions are arranged to face spaces between at least some of the second individual wall portions, respectively, in the axial direction of the inner tubular member.

9. The fuel supply device of claim 8, wherein at least one of the first distribution wall portion and the second distribution wall portion further comprises a plurality of base portions formed between the first individual wall portions and/or the second individual wall portions to be higher than the outer surface of the inner tubular member.

10. The fuel supply device of claim 8, wherein at least one of the first distribution wall portion and the second distribution wall portion further comprises a plurality of base portions formed between the first individual wall portions and/or the second individual wall portions to be coplanar with the outer surface of the inner tubular member.

11. The fuel supply device of claim 8, wherein a number of the first individual wall portions along the first circumference of the inner tubular member is the same as a number of the second individual wall portions along the second circumference of the inner tubular member.

12. The fuel supply device of claim 8, wherein a number of the first individual wall portions along the first circumference of the inner tubular member is different from a number of the second individual wall portions along the second circumference of the inner tubular member.

13. The fuel supply device of claim 8, wherein the first individual wall portions are spaced apart from one another at first intervals along the first circumference of the inner tubular member, and the second individual wall portions are spaced apart from one another at second intervals along the second circumference of the inner tubular member.

14. The fuel supply device of claim 13, wherein the first intervals are the same as the second intervals.

15. The fuel supply device of claim 13, wherein the first intervals are different from the second intervals.

* * * * *